US009068406B2

(12) United States Patent
Clasen et al.

(10) Patent No.: US 9,068,406 B2
(45) Date of Patent: Jun. 30, 2015

(54) TONG POSITIONING ARM

(75) Inventors: Ditmar Clasen, Hannover (DE); Martin Liess, Seelze (DE); Martin Helms, Burgdorf (DE)

(73) Assignee: Weatherford Technology Holdings, LLC, Houston, TX (US)

( * ) Notice: Subject to any disclaimer, the term of this patent is extended or adjusted under 35 U.S.C. 154(b) by 503 days.

(21) Appl. No.: 12/947,720

(22) Filed: Nov. 16, 2010

(65) Prior Publication Data

US 2011/0120730 A1 May 26, 2011

Related U.S. Application Data

(60) Provisional application No. 61/281,590, filed on Nov. 19, 2009.

(51) Int. Cl.

| | |
|---|---|
| ***E21B 19/00*** | (2006.01) |
| ***E21B 19/16*** | (2006.01) |
| ***E21B 19/24*** | (2006.01) |

(52) U.S. Cl.

CPC ..... *E21B 19/165* (2013.01); *E21B 19/24* (2013.01)

(58) Field of Classification Search

USPC ..... 175/161, 162, 85.1, 220, 85; 408/237, 408/234, 236; 166/77.51, 85.1; 414/745.1, 414/22.51, 22.63, 22.68, 22.71, 680, 715, 414/718, 806, 815; 405/166, 168.4, 169

See application file for complete search history.

(56) References Cited

U.S. PATENT DOCUMENTS

| | | | | |
|---|---|---|---|---|
| 2,030,045 | A * | 2/1936 | Billings | 414/726 |
| 3,004,674 | A * | 10/1961 | Griffith | 414/690 |
| 4,296,833 | A | 10/1981 | Ashworth | |
| 4,548,544 | A * | 10/1985 | Van Appledorn | 198/750.11 |
| 5,469,647 | A * | 11/1995 | Profio | 37/398 |
| 7,178,612 | B2 | 2/2007 | Belik | |
| 2003/0221871 | A1 * | 12/2003 | Hamilton et al. | 175/85 |
| 2005/0061548 | A1 | 3/2005 | Hooper et al. | |
| 2006/0118335 | A1 * | 6/2006 | Belik | 175/57 |
| 2008/0217067 | A1 | 9/2008 | Ge | |
| 2008/0257607 | A1 | 10/2008 | Winter | |
| 2009/0205442 | A1 | 8/2009 | Hunter | |

FOREIGN PATENT DOCUMENTS

| | | | |
|---|---|---|---|
| GB | 807892 | A | 1/1959 |
| GB | 2191989 | A | 12/1987 |
| WO | 2007106999 | A1 | 9/2007 |

OTHER PUBLICATIONS

Canadian Office Action dated May 13, 2013, Canadian Patent Application No. 2,721,852.

European Search Report; European Application No. 10191787.0; Dated Mar. 5, 2013.

* cited by examiner

*Primary Examiner* — William P Neuder
*Assistant Examiner* — Ronald Runyan
(74) *Attorney, Agent, or Firm* — Patterson & Sheridan, LLP

(57) ABSTRACT

The present invention generally relates to an apparatus for positioning a tool at a well site. The apparatus includes a first arm rotationally connected to a guide on a column. The apparatus further includes a second arm rotationally connected to the first arm. The second arm is also connected to a tool attachment member at a pivot point, wherein the pivot point is offset from the centerline of the tool. Additionally, the apparatus includes a flexible tension member having one end operatively connected to the guide and another end connected to the tool attachment member at a location closer to the centerline of the tool than the pivot point, wherein the flexible tension member is configured to maintain the tool in a specific orientation around the pivot point during the positioning operation. In a further aspect, a method of positioning a tool at a wellsite is provided.

34 Claims, 10 Drawing Sheets

TONG POSITIONING ARM

CROSS-REFERENCE TO RELATED APPLICATIONS

This application claims benefit of U.S. provisional patent application Ser. No. 61/281,590, filed Nov. 19, 2009, which is herein incorporated by reference.

BACKGROUND OF THE INVENTION

1. Field of the Invention

Embodiments of the present invention generally relate to handling of wellbore tools. More particularly, embodiments of the present invention relate to an apparatus for positioning a tool.

2. Description of the Related Art

During a drilling operation, a drill string is used to form a wellbore. The drill string is made from multiple lengths of drill pipe. Typically, a tong is used to connect the drill pipe to the drill string. The tong rotates the drill pipe to screw the pin end of the drill pipe into the box end of the drill string. The tong provides the torque necessary to make-up (or break-out) the connection. At various times during the drilling operation, the tong is moved between several locations at the well site, such as at well centerline, mouse holes, or a storage position. Due to the size and the weight of the tong, the movement of the tong may be difficult. Therefore, there is a need for an apparatus and method for moving the tong at the well site.

SUMMARY OF THE INVENTION

The present invention generally relates to a tool for positioning a tool. In one aspect, an apparatus for positioning a tool at a well site is provided. The apparatus includes a first arm rotationally connected to a guide on a column. The apparatus further includes a second arm rotationally connected to the first arm. The second arm is also connected to a tool attachment member at a pivot point, wherein the pivot point is offset from the centerline of the tool. Additionally, the apparatus includes a flexible tension member having one end operatively connected to the guide and another end connected to the tool attachment member at a location closer to the centerline of the tool than the pivot point, wherein the flexible tension member is configured to maintain the tool in a specific orientation around the pivot point during the positioning operation.

In another aspect, an apparatus for positioning a tool at a wellsite is provided. The apparatus includes a first arm pivotally connected to a guide on a column. The apparatus further includes a second arm pivotally connected to the first arm and an attachment member, wherein the attachment member is configured to attach to the tool. The apparatus also includes a connecting member pivotally connected to the second arm and the guide. Additionally, the apparatus includes a cylinder and piston rod assembly pivotally connected to the guide and the first arm, wherein the cylinder and piston rod assembly is configured to rotate the first arm relative to the guide, which causes the second arm to move the tool between an extended position and a retracted position along a substantially horizontal plane.

In another aspect, an apparatus for positioning a tool at a wellsite is provided. The apparatus includes a first arm connected to a guide on a column at a first pivot point. The apparatus further includes a second arm connected to the first arm at a second pivot point and connected to a tool attachment member at a third pivot point. Additionally, the apparatus includes a connecting member attached to the second arm at a fourth pivot point and attached to the guide at a fifth pivot point, wherein the second pivot point is between the third pivot point and the fourth pivot point. The rotational movement of the first arm around the first pivot point causes the second arm to move the tool.

In a further aspect, a method of positioning a tool at a wellsite is provided. The method includes the step of attaching the tool to a positioning apparatus. The positioning apparatus comprises a first arm pivotally connected to a guide on a column, a second arm pivotally connected to the first arm and a connecting member pivotally connected to the second arm and the guide. The method further includes the step of rotating the first arm relative to the column thereby causing the second arm to move the tool along a substantially horizontal plane.

In yet a further aspect, a method of positioning a tool at a wellsite is provided. The method includes the step of attaching the tool to a positioning apparatus. The positioning apparatus comprises a first arm pivotally connected to a guide on a column, a second arm pivotally connected to the first arm and a flexible tension member operatively attached to the second arm and the guide. The method further includes the step of adjusting an orientation of the tool by manipulating the length of the flexible tension member. Additionally, the method includes the step of rotating the first arm relative to the column thereby causing the second arm to move the tool between a retracted position and an extended position.

In an additional aspect, an apparatus for positioning a tool at a wellsite is provided. The positioning apparatus includes a first arm rotationally connected to a base. The positioning apparatus further includes a second arm rotationally connected to the first arm. The positioning apparatus also includes an extension arm connected between the second arm and a tool attachment member. In addition, the positioning apparatus includes a stabilizing member connected to the tool attachment member. The stabilizing member is configured to maintain the tool in a specific orientation during a positioning operation.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention generally relate to an apparatus for positioning a tool, such as a tong, a pipe-stabilizing tool, a gripping arm, welding equipment or any other wellbore equipment. To better understand the aspects of the present invention and the methods of use thereof, reference is hereafter made to the accompanying drawings.

Figure 1:
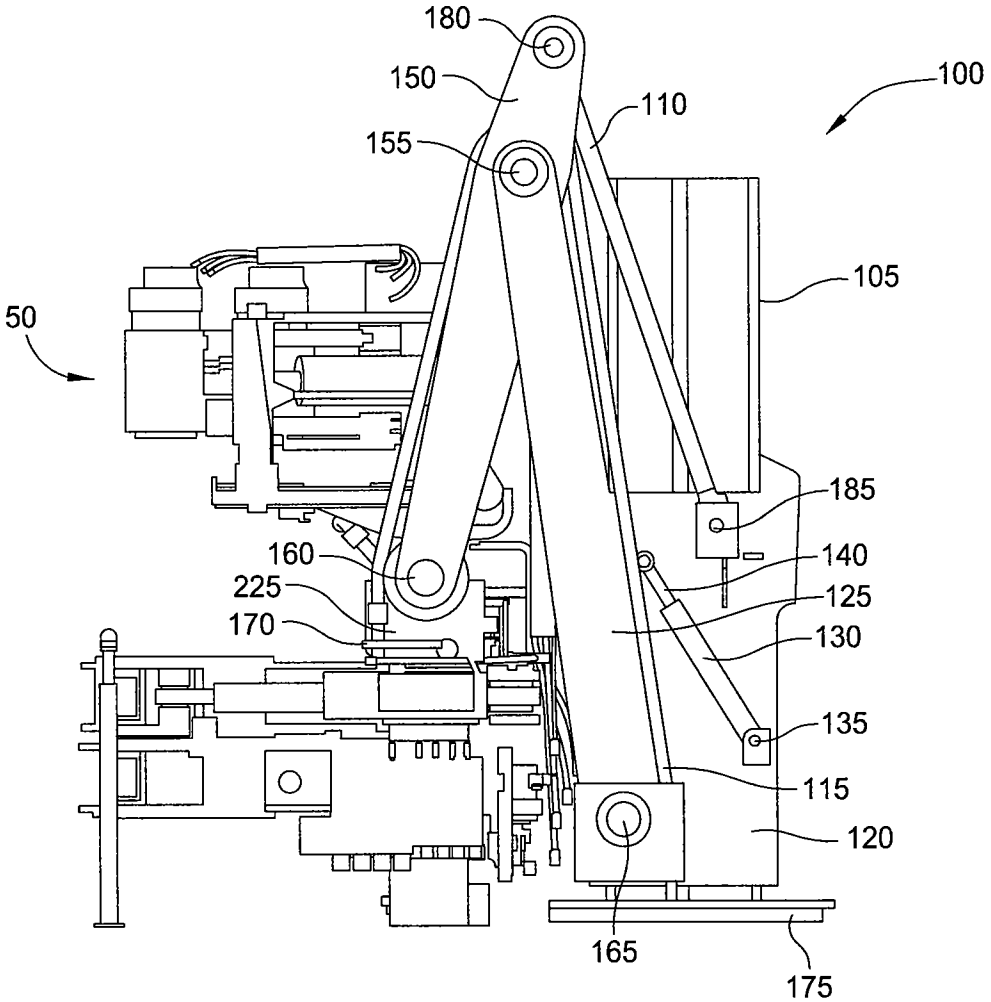
FIG. 1 is a view illustrating a positioning apparatus in a retracted position.
Figure 2:
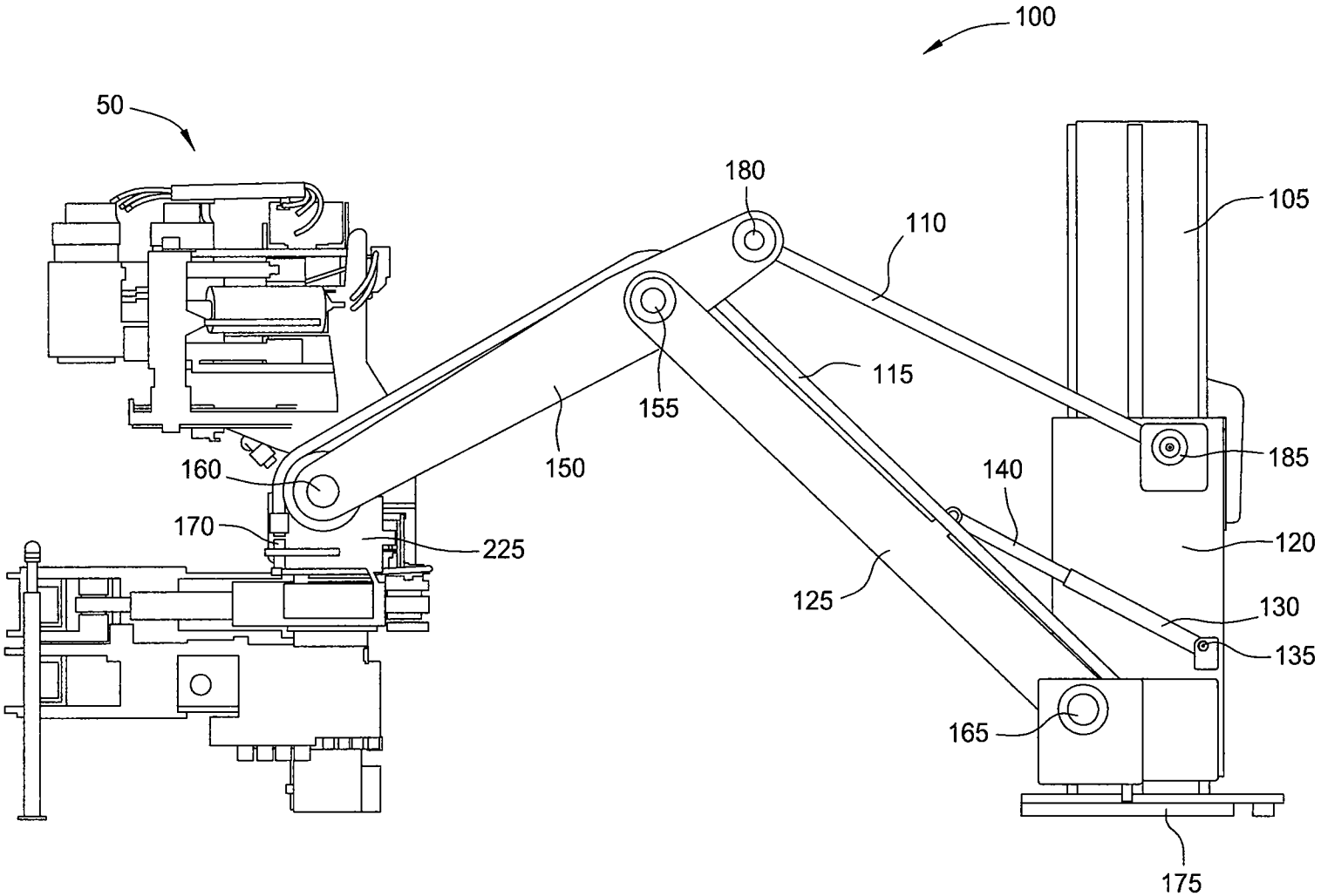
FIG. 2 is a view illustrating the positioning apparatus in an extended position.
Figure 3:
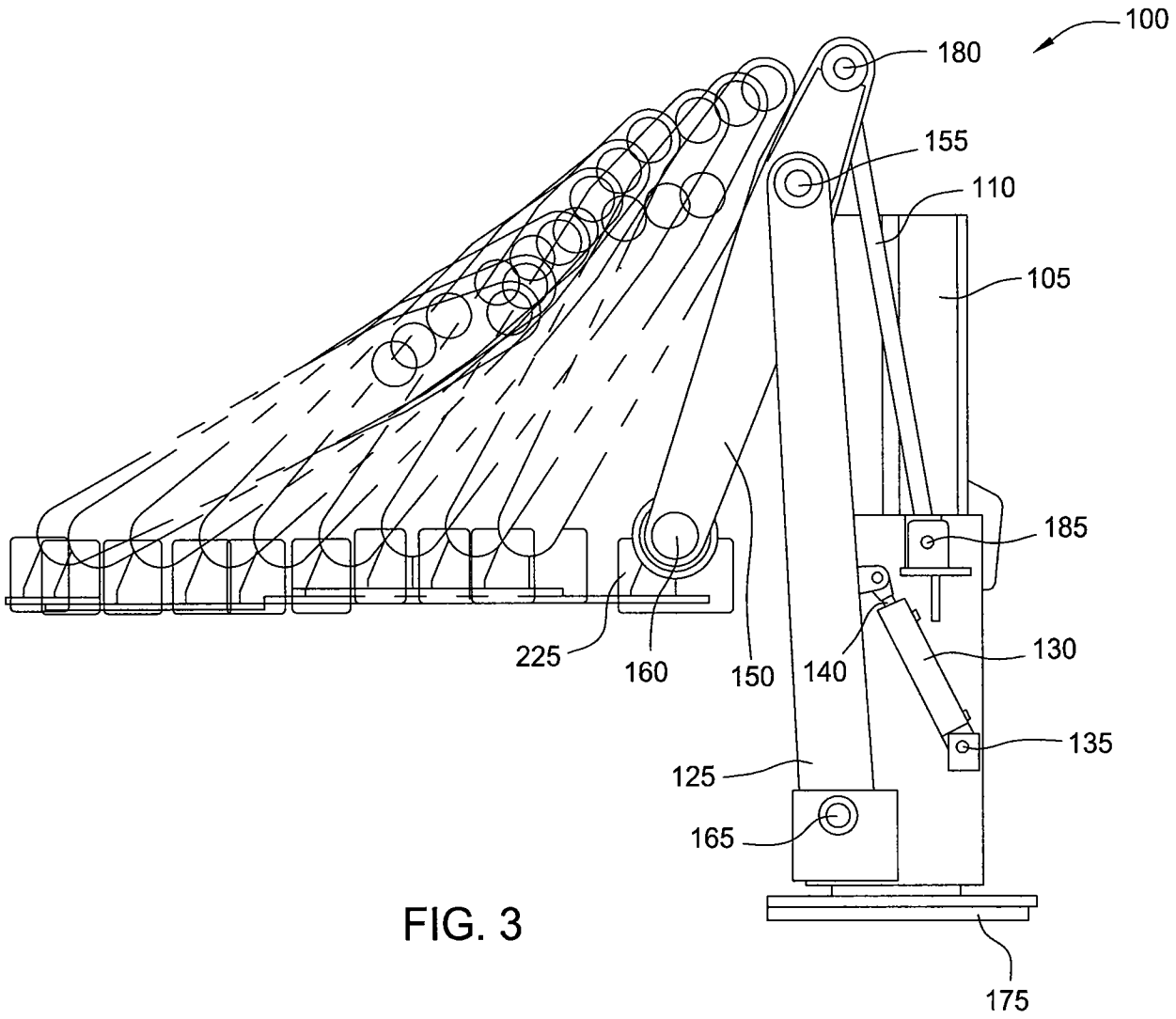
FIG. 3 is a view illustrating the positioning apparatus moving along a substantially horizontal path.

FIG. 1 is a view illustrating a positioning apparatus 100 in a retracted position. The positioning apparatus 100 is used to manipulate the position of a tool 50 at a well site. The positioning apparatus 100 is movable between the retracted position (FIG. 1) and an extended position (FIG. 2). Further, the positioning apparatus 100 may have any number of intermediate positions (FIG. 3). The positioning apparatus 100 may include a base plate 175 for mounting the positioning apparatus 100 at the well site.

Figure 4:
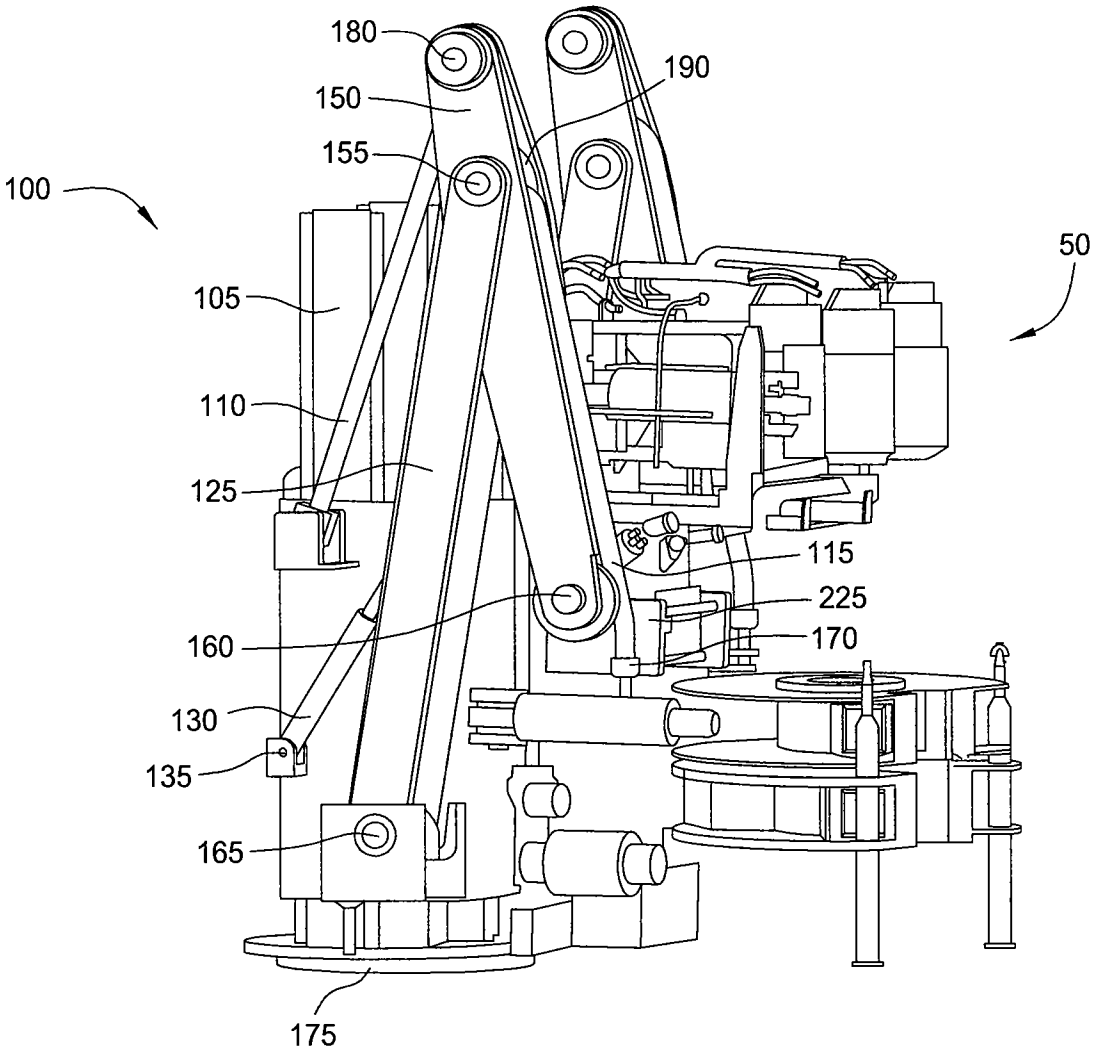
FIG. 4 is another view of the positioning apparatus in the retracted position.
Figure 6:
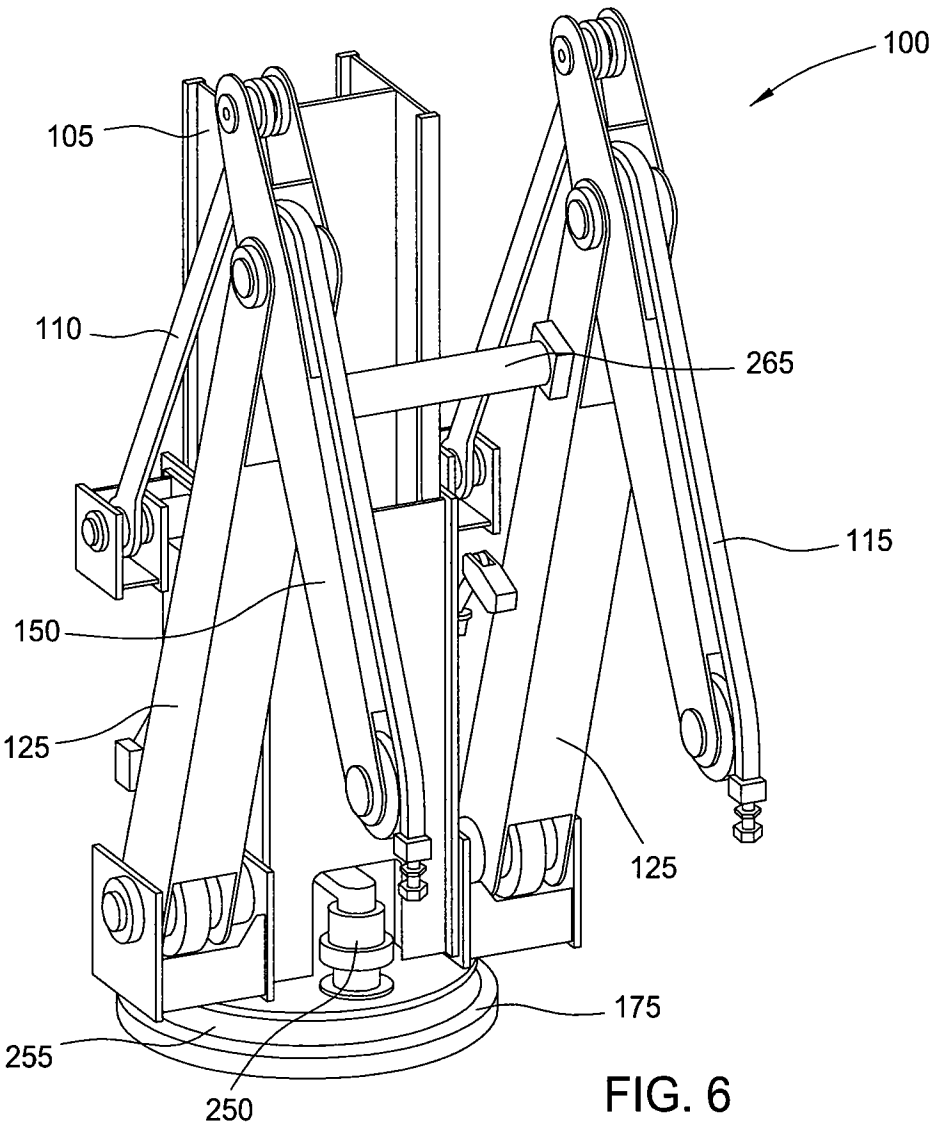
FIG. 6 is a view illustrating a rotation drive for use with the positioning apparatus.

As illustrated in FIG. 1, the positioning apparatus 100 includes a first arm 125 and a second arm 150. The first arm 125 is connected to a guide 120 via a connection member 165, and the first arm 125 is connected to the second arm 150 via a connection member 155. During the positioning operation, the first arm 125 pivots around the connection member 165 to extend and/or retract the second arm 150. The arms 125, 150 may comprise of two members mounted substantially parallel to each other and spaced apart (FIG. 4). Preferably, the positioning apparatus 100 comprises a pair of first arms 125 mounted on either side of the guide 120 and a pair of second arms 150, each mounted to one of the first arms 125. The pair of first arms 125 may be synchronized such that the first arms 125 operate as a single unit. In one embodiment, the pair of first arms 125 are connected by a bar member 265 (FIG. 6). In this embodiment, a single cylinder (not shown) may be connected between the bar member 265 and the guide 120 or any other suitable location on the positioning apparatus 100. This arrangement will allow the single cylinder to operate the first arms 125 rather than the cylinder 130 attached to each first arm 125. In another embodiment, a flow divider or another hydraulic device may be used to interconnect the cylinders 130 of the pair of first arms 125. In a further embodiment, a double-sided cylinder (not shown) may be used to control the movement of the pair of first arms 125.

The first arm 125 is also connected to the guide 120 via the cylinder 130. The cylinder 130 includes a piston rod 140 that is movable relative to the cylinder 130. As the piston rod 140 extends outward from the cylinder 130, the first arm 125 rotates around the connection member 165 in a direction away from the column member 105. As the piston rod 140 retracts into the cylinder 130, the first arm 125 rotates around the connection member 165 in a direction toward the column member 105. In other words, the piston rod 140 of the cylinder 130 controls the movement of the arms 125, 150 of the positioning apparatus 100. In another embodiment, the cylinder 130 may be positioned between the first arm 125 and the second arm 150. The cylinders of the positioning apparatus 100 may be connected to the hydraulic system of the tool 50 such that the tool 50 and the positioning apparatus 100 may be operated by a single control panel on the tool 50 or by a remote control device.

In one embodiment, the cylinders used in the positioning apparatus 100 are hydraulic counterbalance cylinders. The hydraulic counterbalance cylinders are configured as a pipe break safety valve, whereby if hydraulic pressure is lost in the system, then the hydraulic counterbalance cylinders will lock in position. Generally, the hydraulic counterbalance cylinders include a check valve arrangement on the rod side that can be opened by pilot pressure. The pressure on the incoming line on the piston side of the cylinder is used to open the check valve arrangement on the rod side. If the pressure on the incoming line is lost, then the check valve arrangement closes and the rod is locked in place. The locking of the rod causes the positioning apparatus 100 to become locked so that the tool 50 will not be dropped if hydraulic pressure in the system is lost.

The second arm 150 is connected to the first arm 125 via the connection member 155. The second arm 150 is also connected to the guide 120 by a connecting member 110. The connecting member 110 may be any type of member that is capable of operating in tension, such as a rod, a rope, or a chain. As illustrated, the connecting member 110 is attached to the guide 120 via a connection member 185, and the connecting rod is attached to the second arm 150 via a connection member 180. Preferably, the connecting member 110 is a fixed length rod, which controls the movement of the second arm 150 as the first arm 125 rotates around the connection member 165. As will be described herein, the first arm 125 and the second arm 150 are configured such that the positioning apparatus 100 can move the tool 50 along a substantially horizontal path during the positioning operation.

The second arm 150 is connected to a tool attachment member 225 via a connection member 160. The tool attachment member 225 is able to rotate around the connection member 160 as the positioning apparatus 100 moves between the retracted position and the extended position. The tool attachment member 225 may be configured to grip and support the tool 50 during and after the positioning operation. In one embodiment, the tool attachment member 225 comprises a plurality of plates that are connected on a base portion of the tool 50. In another embodiment, the tool 50 may be welded to the attachment member 225. In a further embodiment, the attachment member 225 may comprise releasable jaws configured to hold the tool 50.

The positioning apparatus 100 may include a column member 105 mounted to the base plate 175. A guide 120 is disposed on the column member 105, and the guide 120 is rotationally fixed with respect to the column member 105. The column member 105 may be rotated about its longitudinal axis to place the tool 50 at any desired location about the column member 105. A rotational drive may be used to rotate the column member 105, such as a hydraulic motor (FIG. 6). In another embodiment, the guide 120 may be rotatable relative to the column member 105. A motor (not shown) may be used to rotate the guide 120 relative to the column member 105. The guide 120 is movable along the longitudinal axis of the column member 105, which allows the positioning apparatus 100 to raise and lower the tool 50 during the positioning operation. In other words, the tool 50 moves in a vertical direction as the guide 120 moves along the longitudinal axis of the column member 105. A hydraulic or pneumatic cylinder (not shown) may be used to move the guide 120 along the longitudinal axis of the column member 105.

As shown in FIG. 1, the tool attachment member 225 is connected to a tension member 115, such as a chain, a belt or a cable. Preferably, the tension member 115 is flexible to allow the tension member 115 to bend around the rollers 190 (FIG. 4). The tension member 115 is attached to the tool attachment member 225 via a connection member 170. The tension member 115 is also connected to the bracket through which the connection member 165 runs. The bracket is attached to the guide 120. The tension member 115 may alternatively be connected to the arm 125 or to the guide 120. As such, the tool attachment member 225 is operatively connected to the guide 120 via a tension member 115. The tension member 115 loops around the roller 190 (FIG. 4) or sprocket disposed between the portions of the second arm 150.

The tension member 115 is configured to stabilize the tool 50 such that the tool 50 is maintained in a specific orientation (e.g., a substantially vertical position or a tilted position) during the positioning operation. The tool 50 is free to pivot about the connection member 160; however, the tension member 115 prevents the tool 50 from pivoting beyond a set limit in one direction. The second arm 150 and the tension member 115 are attached to the tool attachment member 225 at a location that is offset from the center of gravity of the tool 50. As shown, the tension member 115 is connected to the attachment member 225 at a location closer to the center of gravity of the tool 50 than the second arm 150. The arrangement of the connection points to the tool 50 allows the tension member 115 to stabilize the tool 50 as the positioning apparatus 100 moves the tool 50 along a substantially horizontal plane during the positioning operation.

The tension member 115 may be fixed in length or the length may be adjustable. In one embodiment, the positioning apparatus 100 may include an adjustment mechanism (not shown) configured to adjust the length of the tension member 115 and thus the orientation of the tool 50. For example, if the adjustment mechanism increases the length of the tension member 115, then the tool 50 will pivot about the connection member 160 in a first direction. Alternatively, if the adjustment mechanism decreases the length of the tension member 115, then the tool 50 will pivot about the connection member 160 in a second opposite direction. As such, the adjustment mechanism can adjust the orientation of the tool 50 such that the tool 50 may be in a downward tilted orientation, a substantially vertical orientation, or upward tilted orientation. Further, the adjustment mechanism may adjust the orientation of the tool 50 prior to moving the tool 50 in the positioning operation or after moving the tool 50 to the desired position. Additionally, the adjustment mechanism may be configured to adjust the orientation of the tool 50 while the positioning apparatus 100 moves the tool 50 during the positioning operation. The adjustment mechanism may be any mechanism known in the art that is configured to adjust the length of the tension member 115, such as a lever mechanism, a turnbuckle, a hydraulic cylinder and roller (or pulley) arrangement or a sprocket arrangement. Additionally, the adjustment mechanism may be operated by manual manipulation or the adjustment mechanism may be controlled by a control system, such as the operating control system of the positioning apparatus 100.

FIG. 2 is a view illustrating the positioning apparatus 100 in an extended position. As illustrated, the piston rod 140 of the cylinder 130 has been extended. The movement of the piston rod 140 of the cylinder 130 causes the first arm 125 to pivot around the connection member 165. The second arm 150 is free to rotate around the connection member 155. The rotation of the second arm 150 is controlled by the connecting member 110 such that the upper end of the second arm 150 is maintained closer to the column 105 than the connection member 155. Hence, the lower end of the second arm 150 is pivoted away from the column 105. As the second arm 150 moves away from the column 105, the tool 50 is moved along the substantially horizontal plane as shown in FIG. 3.

FIG. 4 is another view of the positioning apparatus 100 in the retracted position. As illustrated, the arms 125, 150 may include two members mounted substantially parallel to each other and spaced apart. Each of the arms 125, 150 are configured to move together as a unit during the positioning operation. Also illustrated in FIG. 4 is the rollers 190 (alternatively axles, pulleys or sprockets) for use with the tension member 115. The rollers 190 may be stationary or the rollers 190 may be rotatable. As previously set forth, the tension member 115 is used to stabilize the tool 50 such that the tool 50 is maintained in the specific orientation during the positioning operation.

Figure 5B:
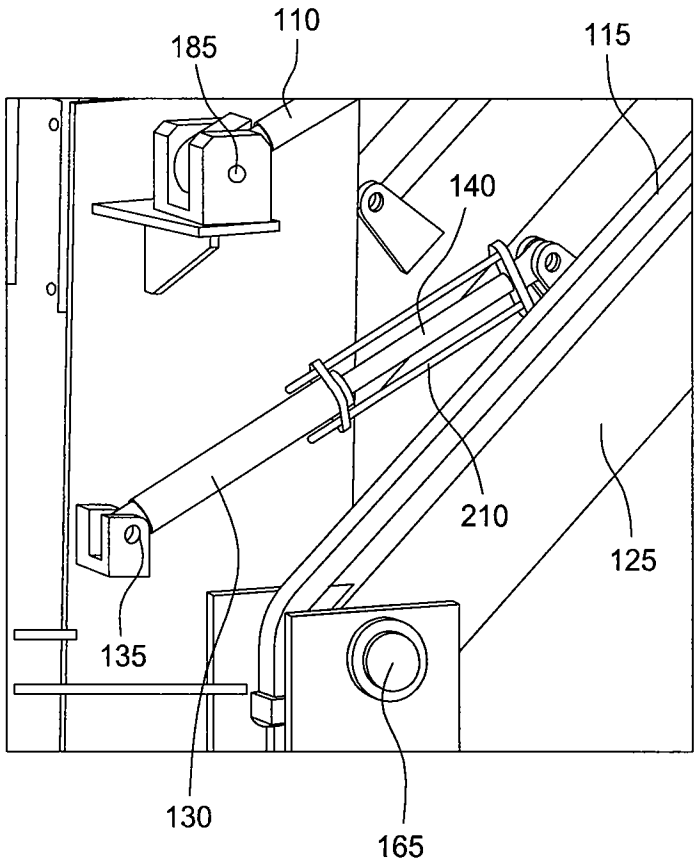
FIGS. 5A and 5B are views illustrating a cylinder member as the positioning apparatus moves between the retracted position and the extended position.
Figure 5A:
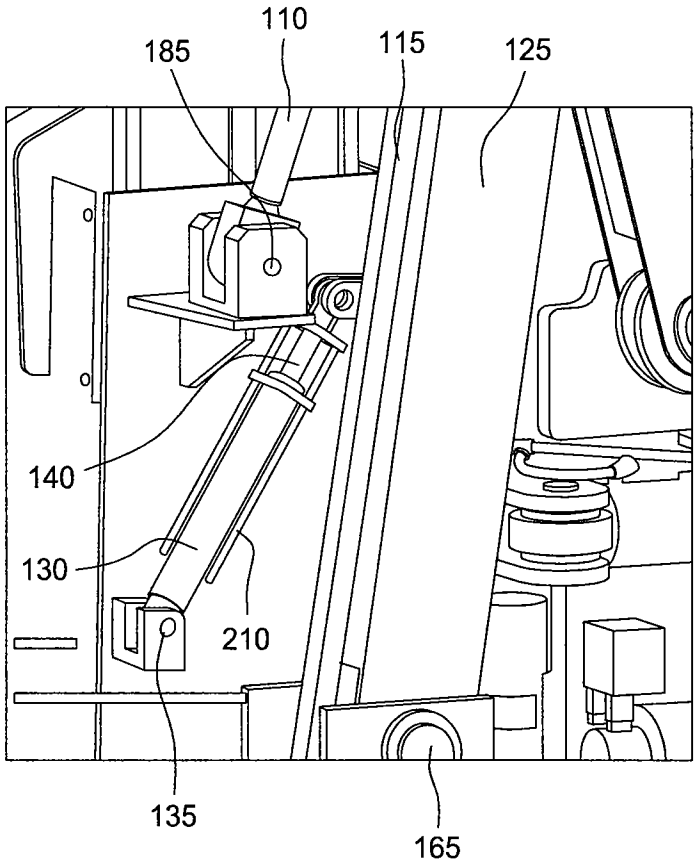

FIGS. 5A and 5B are views illustrating the cylinder 130 as the positioning apparatus 100 moves between the retracted position and the extended position. In one embodiment, the position of the positioning apparatus 100 may be set by using a position assembly 210 attached to the cylinder 130. As set forth herein, the movement of the piston rod 140 of the cylinder 130 controls the movement of the arms 125, 150 and therefore controls the movement of the tool 50. If the tool 50 is to be placed at a location multiple times, then the position assembly 210 may be used to limit the extension of the piston rod 140 such that tool 50 is placed at the same location each time the positioning apparatus 100 is in the extended position. In the embodiment illustrated in FIGS. 5*a* and 5*b*, the position assembly 210 includes a plurality of rods and plates. Nuts on the rods may be adjusted such that the extension of the piston rod 140 may be limited. In other embodiments, sensors may be used to monitor the extension of the piston rod 140 of the cylinder 130. The sensors may be limit switches. The sensors may form part of a control circuit, which limits movement of the piston rod 140 when a pre-set extension has been reached. The sensors may also be configured to measure the movement of the piston rod 140 along a travel path inside the cylinder 130. The sensors are linked to the control circuit attached to the cylinder 130. When the piston rod 140 becomes close to a predetermined location along the travel path, the sensors will send a signal to the control circuit to reduce the fluid flow to the cylinder 130, which in turn slows the movement of the piston rod 140 and the movement of the positioning apparatus 100. Upon reaching the predetermined location along the travel path, the sensor will send a signal to the control circuit to stop the fluid flow to the cylinder 130, which in turn stops the movement of the piston rod 140 and the movement of the positioning apparatus 100.

Figure 7:
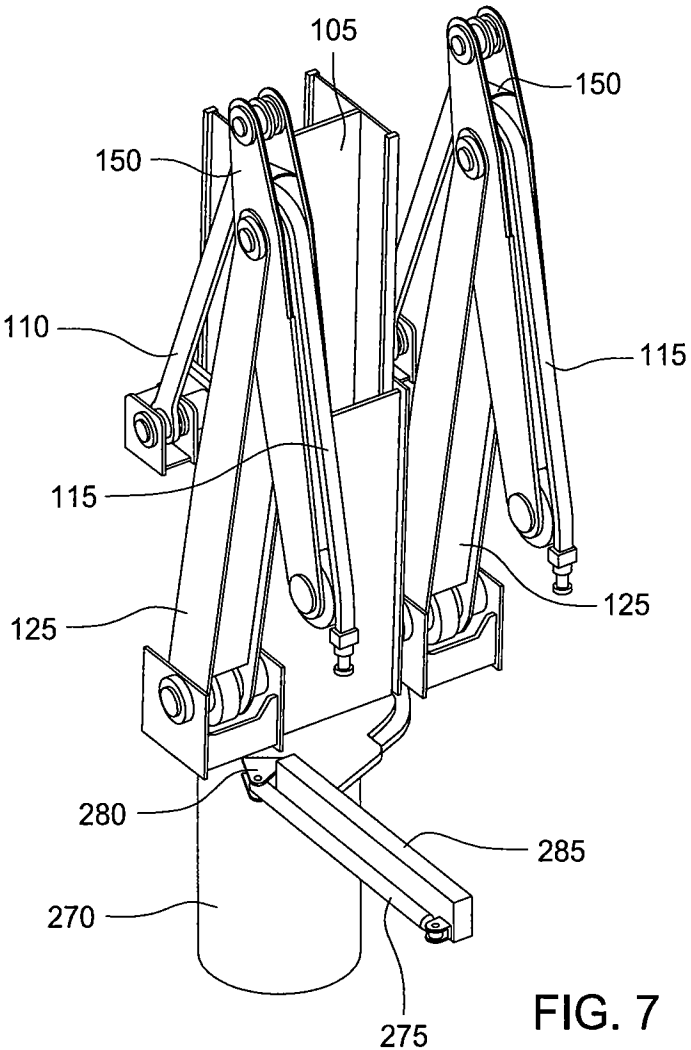
FIG. 7 is a view illustrating a rotation drive for use with the positioning apparatus.

FIG. 6 is a view illustrating a rotation drive for use with the positioning apparatus 100. In one embodiment, the rotational drive may be a hydraulic motor 250 attached to a slewing ring 255. For clarity, the tool 50 is not shown in FIG. 6. The hydraulic motor 250 includes a gear member that interacts with an internal gear of the slewing ring 255. Upon activation of the rotational drive, the hydraulic motor 250 rotates the internal gear of the slewing ring 255, thereby causing the column member 105 to rotate along its longitudinal axis. In another embodiment, the rotational drive may be a cylinder 275 that is connected to a bracket 280 fixed to a post 270 as illustrated in FIG. 7. For clarity, the tool 50 is not shown in FIG. 7. The cylinder 275 is mounted in a bracket 285 that is attached to the column 105. Upon activation of rotational drive, the cylinder 275 applies a force on the bracket 280 fixed to the post 270, thereby causing the column member 105 to rotate along its longitudinal axis.

Figure 8:
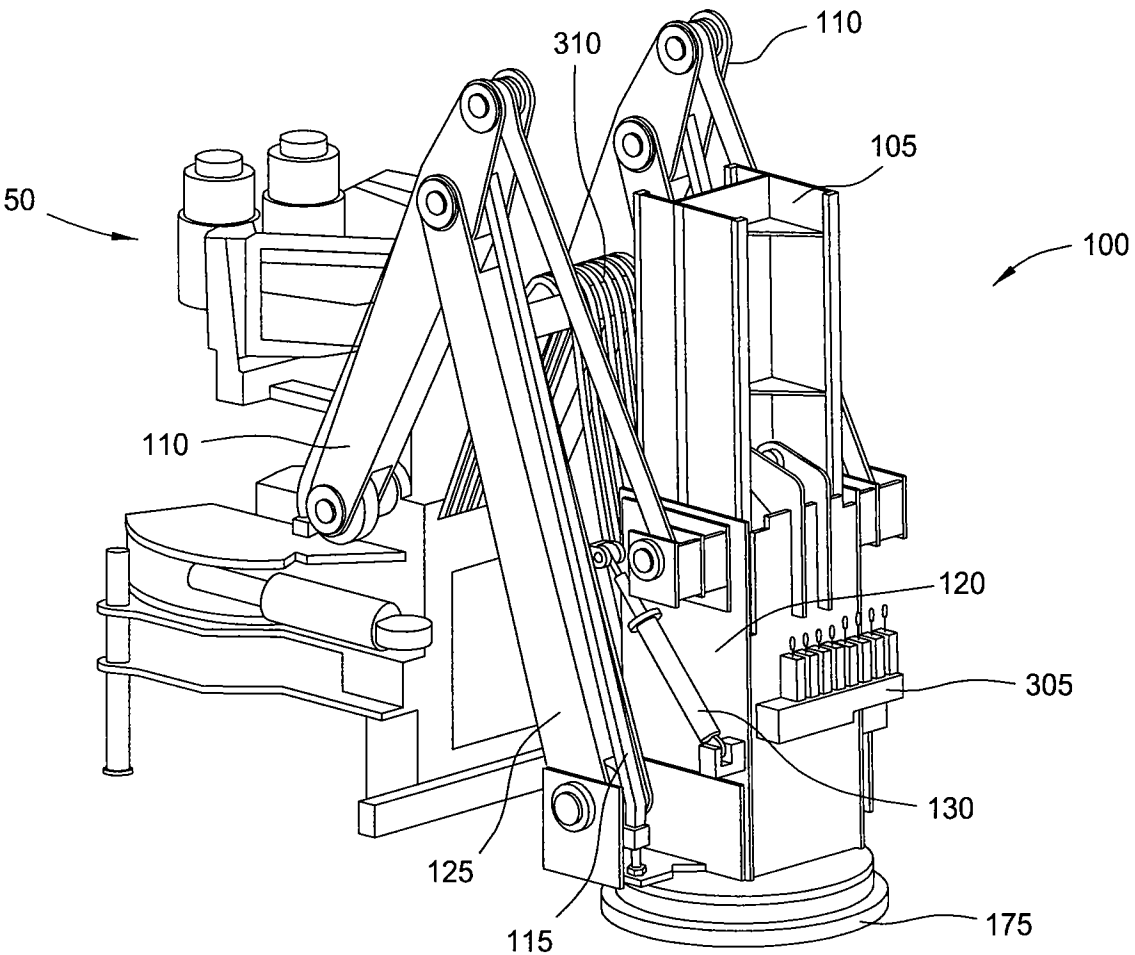
FIG. 8 is a view illustrating the positioning apparatus with a control panel.

FIG. 8 is a view illustrating the positioning apparatus 100 with a control panel 305. As shown in FIG. 8, the control panel 305 is connected to the guide 120 to allow the control panel 305 to move along with the guide 120 during the positioning operation. It should be understood, however, that the control panel 305 may located at any suitable location on the positioning apparatus 100 without departing from principles of the present invention. The control panel 305 is connected to a control circuit on the positioning apparatus 100, which controls the operation of the cylinders of the positioning apparatus 100. The control panel 305 may be configured to control all axis of motion (vertical, horizontal, rotation) of the tool 100. The control panel 305 may also be connected to the tool 50 via one or more hydraulic or pneumatic hoses 310. In this manner, the control panel 305 may be configured to control the positioning apparatus 100 and the tool 50. Additionally, this arrangement allows the positioning apparatus 100 to control different tools using the same control panel 305. In other words, the positioning apparatus 100 and the control panel 305 may be used with different wellbore tools (e.g., tongs) to allow the interchangeability of tools.

Figure 9:
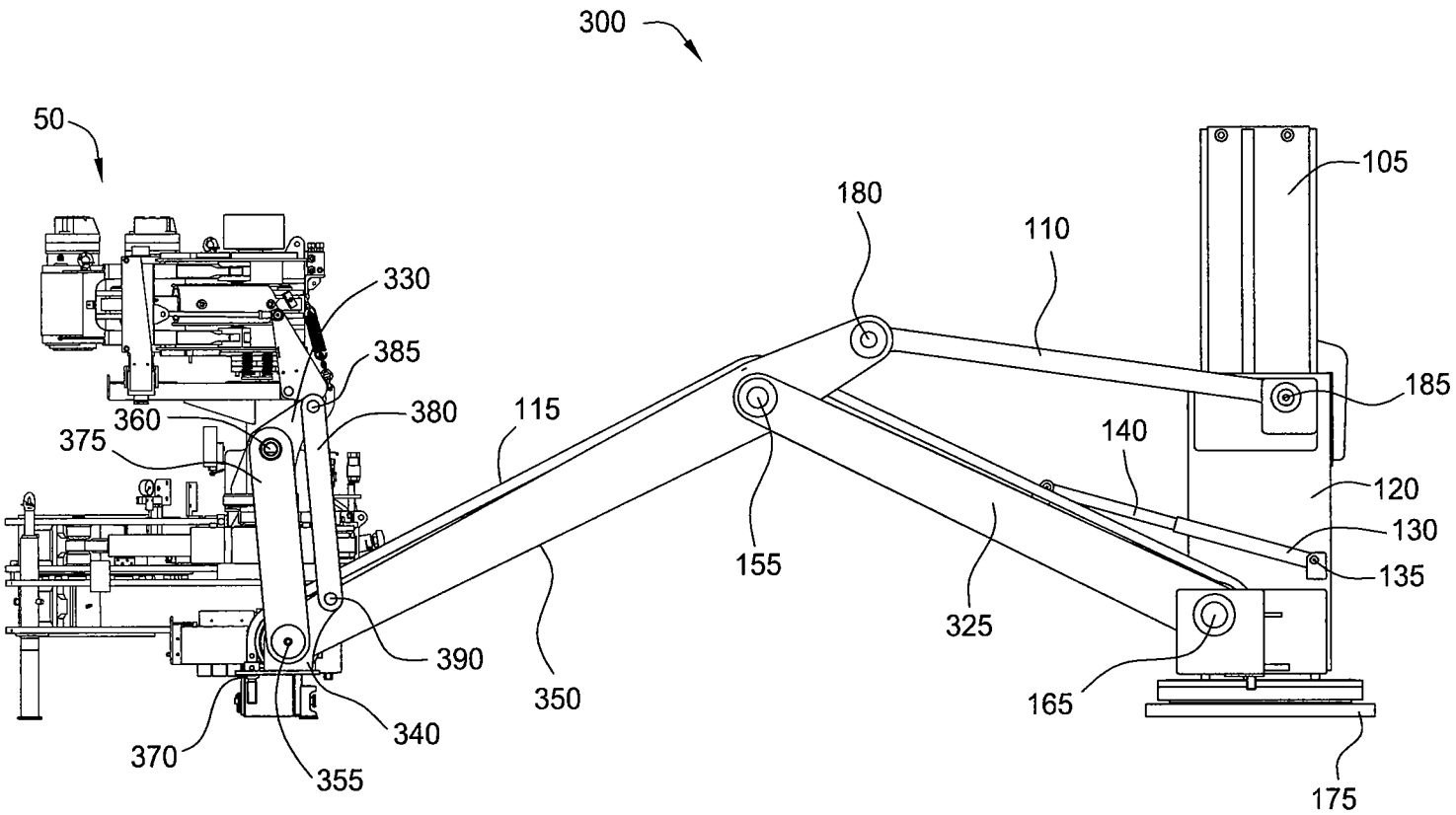
FIG. 9 is a view illustrating a positioning apparatus with an extension arm in a first position.

FIG. 9 is a view illustrating a positioning apparatus 300 with an extension arm 375. For convenience, the components in the positioning apparatus 300 that are similar to the components in the positioning apparatus 100 will be labeled with the same number indicator. The positioning apparatus 300 is used to manipulate the position of the tool 50 at a well site. The positioning apparatus 300 is movable between a retracted position, multiple intermediate positions and an extended position in a similar manner as the positioning apparatus 100. The positioning apparatus 300 may be moved to a position that beyond the extended position by using the extension arm 375.

As illustrated in FIG. 9, the positioning apparatus 300 includes a first arm 325 and a second arm 350. The first arm 325 is connected to the guide 120 via the connection member 165, and the first arm 325 is connected to the second arm 350 via the connection member 155. During the positioning operation, the first arm 325 pivots around the connection member 165 to extend and/or retract the second arm 350. The arms 325, 350 may comprise of two members mounted substantially parallel to each other and spaced apart. Preferably, the positioning apparatus 300 comprises a pair of first arms 325 mounted on either side of the guide 120 and a pair of second arms 350, each mounted to one of the first arms 325. The pair of first arms 325 may be synchronized such that the first arms 325 operate as a single unit. The connecting member 110 connects the second arm 350 to the guide 120. The connecting member 110 may be any type of member that is capable of operating in tension, such as a rod, a rope, or a chain. Preferably, the connecting member 110 is a fixed length rod, which controls the movement of the second arm 350 as the first arm 325 rotates around the connection member 165. The first arm 325 and the second arm 350 are configured such that the positioning apparatus 300 can move the tool 50 along a substantially horizontal path during the positioning operation.

The positioning apparatus 300 further includes the extension arm 375. Generally, the extension arm 375 is used to extend the reach of the positioning apparatus 300 past the extended position. The extension arm 375 is an optional component that may be used to allow the tool 50 to be placed at the centerline of the wellbore, mouse holes, or another position offset from the centerline of the wellbore.

Figure 10:
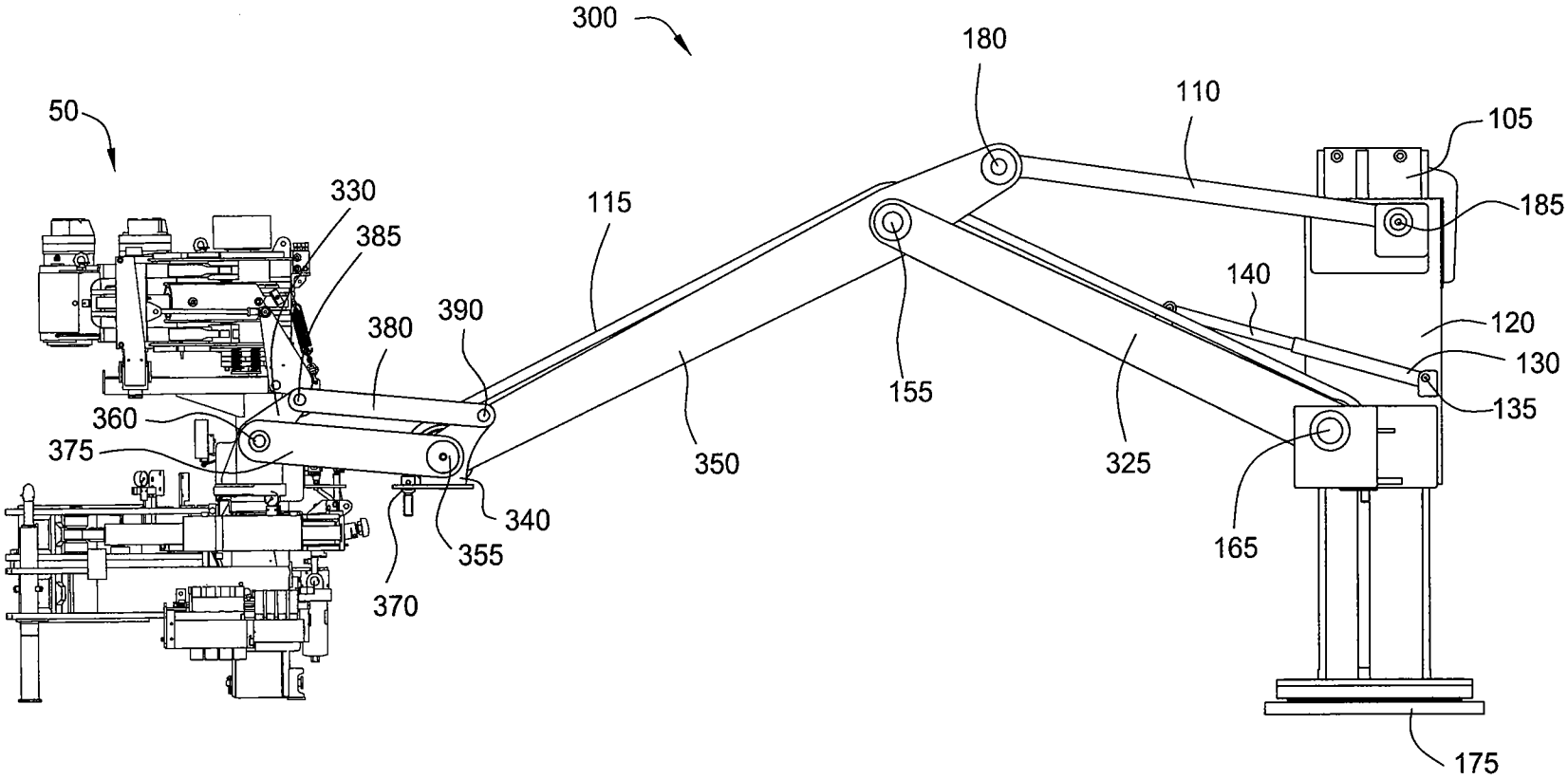
FIG. 10 is a view illustrating the positioning apparatus in FIG. 9 with the extension arm in a second extended position.

As shown in FIG. 9, connection members 355, 360, 385 and 390 are used to connect an optional stabilizing member 380, an arm attachment member 340, a tool attachment member 330 and the extension arm 375. Connection member 355 is also used to connect the extension arm 375 to the second arm 350. The extension arm 375 is configured to rotate around the connection member 355 between a first position (FIG. 9) and a second extended position (FIG. 10). The extension arm 375 may be rotated relative to the second arm 350 by a hydraulic piston, mechanical linkage or any other rotation device known in the art.

The tension member 115 is connected to the arm attachment member 340 by a connection arrangement 370. The tension member 115 works in conjunction with the optional stabilizing member 380 to stabilize the tool 50 such that the tool 50 is maintained in a specific orientation (e.g., a substantially vertical position or a tilted position) during the positioning operation. The tool 50 is free to pivot about the connection member 360; however, the stabilizing member 380 and the tension member 115 prevent the tool 50 from pivoting beyond a set limit in one direction. The extension arm 375 and the stabilizing member 380 are attached to the tool attachment member 330 at a location that is offset from the center of gravity of the tool 50. The arrangement of the connection points to the tool 50 allows the stabilizing member 380 and the tension member 115 to stabilize the tool 50 as the positioning apparatus 300 moves the tool 50 along a substantially horizontal plane during the positioning operation. In another embodiment, the tension member 115 may be connected directly to the tool 50 or the tool attachment member 330.

The stabilizing member 380 may be fixed in length or the length may be adjustable at either connection point. In one embodiment, the positioning apparatus 300 may include an adjustment mechanism (not shown) configured to adjust the length of the stabilizing member 380 and thus the orientation of the tool 50. For example, if the adjustment mechanism increases the length of the stabilizing member 380, then the tool 50 will pivot about the connection member 360 in a first direction. Alternatively, if the adjustment mechanism decreases the length of the stabilizing member 380, then the tool 50 will pivot about the connection member 360 in a second opposite direction. As such, the adjustment mechanism can adjust the orientation of the tool 50 such that the tool 50 may be in a downward tilted orientation, a substantially vertical orientation, or upward tilted orientation. Further, the adjustment mechanism may adjust the orientation of the tool 50 prior to moving the tool 50 in the positioning operation or after moving the tool 50 to the desired position. Additionally, the adjustment mechanism may be configured to adjust the orientation of the tool 50 while the positioning apparatus 300 moves the tool 50 during the positioning operation. The adjustment mechanism may be any mechanism known in the art that is configured to adjust the length of the stabilizing member 380, such as a lever mechanism, a turnbuckle, a hydraulic cylinder and roller (or pulley) arrangement or a sprocket arrangement. Additionally, the adjustment mechanism may be operated by manual manipulation or the adjustment mechanism may be controlled by a control system, such as the operating control system of the positioning apparatus 300. In one embodiment, the stabilizing member 380 is a fixed length rod; however, the stabilizing member 380 may be any type of member that is capable of operating in tension, such as a rope, or a chain.

FIG. 10 is a view illustrating the extension arm 375 in the second extended position. As illustrated, the guide 120 has moved along the longitudinal axis of the column member 105. As also shown, the extension arm 375 has rotated relative to the second arm 350 around the connection member 355 to position the tool 50. In the embodiment shown, the extension arm 375 is rotated independent of the second arm 350 by a rotation drive device attached to the extension arm 375. The rotation drive device may be connected to the control panel 305 attached to the guide 120 (FIG. 8). In any case, the extension arm 375 is rotated relative to the second arm 350 after the second arm 350 is in the extended position (FIG. 9).

In another embodiment, the extension arm 375 may be rotated as the second arm 350 is rotated. The synchronization of the extension arm 375 and the second arm 350 may be accomplished by mechanical linkage and/or with connection with the control circuit on the positioning apparatus 300. In the case of mechanical linkage, the piston rod 140 causes the movement of the first arm 325, the second arm 350 and the extension arm 375. The movement of the piston rod 140 of the cylinder 130 causes the first arm 325 to pivot around the connection member 165. The connecting member 110 controls the rotation of the second arm 350 such that the upper end of the second arm 350 is maintained closer to the column 305 than the connection member 155. Hence, the lower end of the second arm 350 is pivoted away from the column 105. As the second arm 350 moves away from the column 105, the extension arm 375 is rotated around connection member 355.

While the foregoing is directed to embodiments of the present invention, other and further embodiments of the invention may be devised without departing from the basic scope thereof, and the scope thereof is determined by the claims that follow.

The invention claimed is:

1. An apparatus for positioning a tool at a well site, the apparatus comprising:

a first arm rotationally connected to a guide on a column;

a second arm connected to a tool attachment member at a pivot point which is offset from a centerline of the tool and the second arm is rotationally connected to the first arm;

a connecting member pivotally connected to the second arm and the guide; and a flexible tension member having one end operatively connected to the guide and another end connected to the tool attachment member at a location closer to the centerline of the tool than the pivot point, wherein the flexible tension member is configured to apply a tension force to maintain the tool in a specific orientation around the pivot point during the positioning operation.

2. The apparatus of claim 1, wherein the specific orientation is a substantially vertical position.

3. The apparatus of claim 1, wherein the specific orientation is a tilted position.

4. The apparatus of claim 1, further including an adjustment member configured to adjust the length of the flexible tension member and therefore the orientation of the tool.

5. The apparatus of claim 1, wherein the rotational movement of the first arm relative to the column causes the second arm to move the tool between an retracted position and an extended position.

6. The apparatus of claim 5, wherein the adjustment member is configured to adjust the orientation of the tool as the tool is moved between the retracted position and the extended position.

7. The apparatus of claim 1, wherein the rotational movement of the first arm relative to the column causes the second arm to move the tool along a substantially horizontal plane.

8. An apparatus for positioning a tool at a well site, the apparatus comprising:

a first arm rotationally connected to a guide on a column;

a second arm connected to a tool attachment member at a pivot point which is offset from a centerline of the tool and the second arm is rotationally connected to the first arm;

a flexible member having one end operatively connected to the guide and another end connected to the tool attachment member at a location closer to the centerline of the tool than the pivot point, wherein the flexible member is configured to maintain the tool in a specific orientation around the pivot point during the positioning operation; and an adjustment member configured to adjust a length of the flexible member and therefore the orientation of the tool, wherein lengthening the flexible member causes the tool to tilt in one direction around the pivot point and shortening of the flexible member causes the tool to tilt in another direction around the pivot point.

9. An apparatus for positioning a tool at a wellsite, the apparatus comprising:

a first arm pivotally connected to a guide on a column;

a second arm pivotally connected to the first arm and an attachment member, wherein the attachment member is configured to attach to the tool;

a connecting member having a first end pivotally attached to the second arm and a second end pivotally attached to the guide, wherein the connecting member is positioned at an angle relative to the first arm; and a cylinder and piston rod assembly pivotally connected to the guide and the first arm, wherein the cylinder and piston rod assembly is configured to rotate the first arm relative to the guide which causes the second arm to move the tool between an extended position and a retracted position along a substantially horizontal plane.

10. The apparatus of claim 9, further comprising a position assembly attached to the cylinder and piston rod assembly to limit the piston rod extension and thereby control the extended position of the tool.

11. The apparatus of claim 9, wherein the guide is movable along a longitudinal axis of the column.

12. The apparatus of claim 9, wherein the guide and the column are rotatable around a longitudinal axis of the column.

13. The apparatus of claim 9, further comprising a control panel operatively attached to guide, wherein the control panel is configured to control the cylinder and rod assembly.

14. The apparatus of claim 9, further comprising a control panel configured to control all axis of motion of the apparatus.

15. An apparatus for positioning a tool at a wellsite, the apparatus comprising:

a first arm connected to a guide on a column at a first pivot point;

a second arm connected to the first arm at a second pivot point located on the second arm and connected to a tool attachment member at a third pivot point; and a connecting member attached to the second arm at a fourth pivot point located on the second arm and attached to the guide at a fifth pivot point, wherein the second pivot point is between the third pivot point and the fourth pivot point, and wherein rotational movement of the first arm around the first pivot point causes the second arm to move the tool.

16. The apparatus of claim 15, further comprising a flexible tension member having one end operatively connected to the guide and another end connected to the tool attachment member.

17. The apparatus of claim 16, wherein the flexible tension member is configured to maintain the tool in a specific orientation during the positioning operation.

18. The apparatus of claim 15, further comprising a cylinder and piston rod assembly pivotally connected to the guide and the first arm.

19. The apparatus of claim 18, wherein the cylinder and piston rod assembly is configured to rotate the first arm relative to the guide, which causes the second arm to move the tool between an extended position and a retracted position along a substantially horizontal plane.

20. The apparatus of claim 15, wherein the connecting member is in contact with the second arm at the fourth pivot point and the connecting member is in contact with the guide at the fifth pivot point.

21. A method of positioning a tubular gripping tool at a wellsite, the method comprising:

attaching the tool to a positioning apparatus, the positioning apparatus comprising a first arm pivotally connected to an axially movable guide on a column, a second arm pivotally connected to the first arm and a flexible tension member operatively attached to the tool and the guide;

adjusting an angular orientation of the tool relative to a vertical axis by manipulating the length of the flexible tension member; and rotating the first arm relative to the column thereby causing the second arm to move the tool between a retracted position and an extended position and pivoting the first arm relative to the second arm.

22. The method of claim 21, wherein the orientation of the tool is adjusted prior to moving the tool and the orientation is maintained as the tool moves between the retracted position and the extended position.

23. The method of claim 21, wherein the orientation of the tool is adjusted after tool has moved between the retracted position and the extended position.

24. The method of claim 21, wherein the orientation of the tool is adjusted as the tool moves between the retracted position and the extended position.

25. The method of claim 21, wherein the tool moves along a substantially horizontal plane between the retracted position and the extended position.

26. The method of claim 21, further comprising moving the tool in a vertical direction by moving the guide member along a longitudinal axis of the column.

27. The method of claim 21, further comprising rotating the tool around a longitudinal axis of the column.

28. The method of claim 21, wherein the lengthening of the flexible member causes the tool to tilt in one direction around a pivot point and the shortening the flexible member causes the tool to tilt in another direction around the pivot point.

29. An apparatus for positioning a tool at a wellsite comprising:

a first arm rotationally connected to a base;

a second arm rotationally connected to the first arm;

an extension arm connected between a tool attachment member and an arm attachment member connected to the second arm, wherein the tool attachment member is rotatable relative to the tool; and a stabilizing member connected between the tool attachment member and the arm attachment member, the stabilizing member is configured to maintain the tool in a specific orientation during a positioning operation.

30. The apparatus of claim 29, wherein the extension arm is connected to the tool attachment member at a pivot point which is offset from a centerline of the tool.

31. The apparatus of claim 29, further comprising an adjustment member configured to adjust the length of the stabilizing member, whereby increasing the length of the stabilizing member causes the tool to tilt in a first direction around a pivot point and decreasing the length of the stabilizing member causes the tool to tilt in a second direction around the pivot point.

32. A method of positioning a tool at a wellsite, the method comprising:

attaching the tool to a positioning apparatus having a first arm, a second arm, an extension arm and a stabilizing member, wherein the first arm is connected to a guide on a column;

rotating the first arm relative to the column thereby causing the second arm to move the tool from a retracted position to an extended position;

adjusting an orientation of the tool by manipulating the length of the stabilizing member, whereby increasing the length of the stabilizing member causes the tool to tilt in a first direction around a pivot point and decreasing the length of the stabilizing member causes the tool to tilt in a second direction around the pivot point;

moving the tool in a vertical direction by moving the guide member along a longitudinal axis of the column; and moving the tool past the extended position by rotating the extension arm relative to the second arm.

33. The method of claim 32, further comprising adjusting an orientation of the tool by manipulating the length of the stabilizing member.

34. The method of claim 33, wherein increasing the length of the stabilizing member causes the tool to tilt in a first direction around a pivot point and decreasing the length of the stabilizing member causes the tool to tilt in a second direction around the pivot point.

* * * * *